US008015853B2

(12) United States Patent
Steiner et al.

(10) Patent No.: US 8,015,853 B2
(45) Date of Patent: Sep. 13, 2011

(54) CRIMPING TOOL CONSTRUCTION WITH ANGULARLY DISPOSED JAW HEAD ASSEMBLY

(75) Inventors: Richard A. Steiner, East Haddam, CT (US); Joseph Krzyzanski, New Haven, CT (US)

(73) Assignee: Rostra Tool Company, Branford, CT (US)

( * ) Notice: Subject to any disclaimer, the term of this patent is extended or adjusted under 35 U.S.C. 154(b) by 754 days.

(21) Appl. No.: 12/074,122

(22) Filed: Feb. 28, 2008

(65) Prior Publication Data

US 2008/0216548 A1 Sep. 11, 2008

Related U.S. Application Data

(60) Provisional application No. 60/906,006, filed on Mar. 8, 2007.

(51) Int. Cl.
*B25B 7/02* (2006.01)
*B25B 7/12* (2006.01)

(52) U.S. Cl. ..... 72/409.12; 72/409.01; 72/479

(58) Field of Classification Search ..... 72/409.01, 72/409.08, 409.12, 409.19, 479, 409.07, 72/409.11, 409.13, 409.14; 81/348, 350, 81/351, 346, 349

See application file for complete search history.

(56) References Cited

U.S. PATENT DOCUMENTS

| | | | | |
|---|---|---|---|---|
| 2,244,482 | A | 6/1941 | Baxter et al. | 72/409.11 |
| 2,327,650 | A | 8/1943 | Klein | 403/285 |
| 2,382,292 | A | 8/1945 | Carlson | 72/404 |
| 2,411,838 | A | 11/1946 | Swengel | 72/409.14 |
| 2,618,993 | A | 11/1952 | Carlson | 72/409.11 |
| 2,635,494 | A | 4/1953 | Rogoff | 72/409.11 |
| 2,994,238 | A | 8/1961 | Matthysse | 29/517 |
| 3,039,337 | A | 6/1962 | Stuart-Prince | 72/409.11 |
| 3,084,575 | A | 4/1963 | Klein | 72/409.11 |
| 3,181,341 | A | 5/1965 | Thornton et al. | 72/409.11 |
| D201,915 | S | 8/1965 | Werner | D8/58 |
| 3,330,148 | A | 7/1967 | Hornung | 72/409.11 |
| 3,410,129 | A | 11/1968 | Werner | 72/409.11 |
| 3,872,528 | A | 3/1975 | Porter | 7/134 |
| 4,144,737 | A | 3/1979 | Izraeli | 72/409.11 |
| 4,170,154 | A | 10/1979 | Izraeli | 81/313 |
| 5,042,285 | A | 8/1991 | Levy | 72/409.14 |
| 5,722,284 | A | 3/1998 | Linsmeyer | 72/409.14 |
| 6,128,943 | A | 10/2000 | Lemmens | 72/409.01 |
| 6,739,172 | B2 | 5/2004 | Wagner | 72/409.01 |
| 7,000,448 | B2 | 2/2006 | Hamm et al. | 72/409.01 |
| D532,672 | S | 11/2006 | Steiner | D8/52 |
| 7,434,440 | B2 | 10/2008 | Fay | 72/409.1 |
| 7,603,884 | B1 * | 10/2009 | Michrina | 72/409.12 |
| 7,628,052 | B2 | 12/2009 | Zhang | 72/409.16 |
| 2002/0092336 | A1 | 7/2002 | Wagner | 72/409.1 |
| 2008/0078273 | A1 | 4/2008 | Steiner et al. | 81/350 |

* cited by examiner

*Primary Examiner* — Debra M Sullivan
(74) *Attorney, Agent, or Firm* — Cantor Colburn LLP

(57) ABSTRACT

By constructing clamping jaws, which are employed for applying the desired force to the rings to be crimped, and mounting the clamping jaws in a plane which is substantially perpendicular to the plane in which the handle members are positioned or constructing the clamping jaws for arcuate movement relative to the handle members, an easily employed, force generating, crimping tool assembly is achieved wherein the clamping jaws cooperatively associated with the handle members are positioned at a fixed angle relative to the handle members, or are constructed for being arcuately pivotable relative to the handle members. The crimping tool assembly is able to provide the desired crimping forces to rings mounted in areas in which access is virtually impossible to achieve using prior art tool assemblies. Alternatively, if desired, the clamping jaws may be mounted to the handle members at any desired fixed angle.

19 Claims, 17 Drawing Sheets

CRIMPING TOOL CONSTRUCTION WITH ANGULARLY DISPOSED JAW HEAD ASSEMBLY

CROSS REFERENCE TO RELATED APPLICATION

This application is related to U.S. Provisional Patent Application Ser. No. 60/906,006, filed Mar. 8, 2007 entitled CRIMPING TOOL CONSTRUCTION WITH ANGULARLY DISPOSED JAW HEAD ASSEMBLY.

TECHNICAL FIELD

The present invention relates to crimping tools and, more particularly, to crimping tools constructed with a clamping jaws head assembly mounted at a fixed angle, or an adjustable angle, relative to the handle members.

DESCRIPTION OF THE BACKGROUND ART

Crimping tools have become popular and have been constructed in a wide variety of alternate configurations in order to enable various components, usually ring members to be clampingly mounted about plastic pipes or other fittings for sealing these components to each other. Although substantial forces are required in order to crimp or clamp the ring member in the precisely desired position about the desired fittings, most prior art crimping tools are constructed in a manner which requires the application of substantial forces to the handle members in order to enable the jaw members to impart the crimping force to the ring members.

In addition, all prior art crimping tools are constructed with the jaw members and handle members being co-axially aligned with each other, for lying in a single plane. As a result, difficulties are often encountered whenever ring members need to be mounted to pipes and fittings in confined areas, such as are often found between floor joists, under vanities, and along baseboards. However, in spite of the long felt need that has existed for crimping tools constructed in a manner to provide the required clamping forces in a more easily used tool construction as well as a desire for a crimping tool which is capable of being more easily used in a wide variety of confined areas that are often encountered, no prior art construction has been developed which satisfies these needs.

Therefore, it is a principal object of the present invention to provide a crimping tool having a crimping head which is mounted to the handle members with an angular relationship relative thereto.

Another object of the present invention is to provide a crimping tool having the characteristic features described above wherein the crimping tool is constructed in a manner which amplifies the forces applied to the handle members for producing enhanced crimping forces without requiring the application of excessive force to the handle members.

Another object of the present invention is to provide a crimping tool having the characteristic features described above which is capable of being produced using conventional manufacturing techniques.

A further object of the present invention is to provide a crimping tool having the characteristic features described above which is capable of being produced effectively and efficiently, thereby achieving a cost competitive product.

Another object of the present invention is to provide a crimping tool having the characteristic features described above which is capable of being employed with substantially improved convenience over prior art constructions.

Other and more specific objects will in part be obvious and will in part appear hereinafter.

SUMMARY OF THE INVENTION

By employing the present invention, all of the difficulties and drawbacks found in prior art products has been overcome and an easily employed, force generating, crimping tool assembly is achieved wherein the clamping jaws cooperatively associated with the handle members are positioned at a fixed angle relative to the handle members, or are constructed for being arcuately pivotable relative to the handle members. In one preferred embodiment of the present invention, the clamping jaws employed for applying the desired force to the rings to be crimped are mounted in a plane which is substantially perpendicular to the plane in which the handle members are positioned. In this way, the crimping tool assembly of the present invention is able to provide the desired crimping forces to rings mounted in areas in which access is virtually impossible to achieve using prior art tool assemblies. Alternatively, if desired, the clamping jaws may be mounted to the handle members at any desired fixed angle.

In an alternate preferred embodiment of the present invention, the clamping jaws of the crimping tool assembly are constructed for being arcuately pivotable relative to the handle members for enabling the clamping jaws to be positioned at virtually any desired angle relative to the handle members. In this way, regardless of the placement, position, or location of any desired work area in which ring members need to be affixed to pipe assemblies for securely affixing cooperating components to each other, the crimping tool assembly of the present invention is capable of being easily positioned in cooperating association with the ring member for securely clamping and crimping the ring member in the desired position.

By merely adjusting the clamping jaw to be angularly positioned relative to the handle members in any desired position, ease of access and use is realized. In this way, all of the difficulties and drawbacks found in prior art constructions are completely eliminated and use of the present invention in any confined area is easily achieved.

In the preferred embodiment of the present invention, two elongated handle members are constructed and positioned in cooperating relationship with each other, with the handle members mounted for arcuate pivoting movement about a single pivot axis. In this regard, the two elongated handle member are constructed for mating, cooperating, relationship along their adjacent inside edges, with their proximal ends being affixed to each other, establishing a single pivot axis.

In the preferred construction, each handle member incorporates a pair of flanges extending from the side edge of the proximal end of the handle member, with the flanges constructed for being positioned in overlying cooperating relationship with each other. In addition, the flanges incorporate both a receiving aperture formed therein for enabling a single bolt to be passed through the apertures of each flange for securely affixing the handle members to each other, and establishing the pivot axis about which of the handle members are able to operate. In this way, each elongated handle member is freely movable and arcuately pivotable about the pivot axis established by the bolt member.

In addition, in the preferred construction of this embodiment of the present invention, each handle member also incorporates a pair of cooperating, vertically aligned mounting plates formed along the proximal end thereof, positioned adjacent the flanges. Furthermore, each pair of mounting plates is constructed for enabling a clamping jaw mounting or connecting post to be positioned between the mounting plates, with a bolt receiving aperture formed in each mounting plate and in the connecting post for enabling a single bolt to be mounted through the aligned apertures for securely affixing the connecting post to the mounting plates while also establishing a pivot axis for each connecting post.

In the preferred construction, each connecting post comprises a block portion and a stud portion which are coaxially aligned with each other to be in a single plane. The block portion is affixed to the mounting plates of the handle member, while the stud portion is affixed to the clamping jaws.

In accordance with the present invention, the clamping jaws are cooperatively associated with each other to form a clamping jaw head assembly. In the preferred construction of the head assembly, two clamping jaws are employed and are mounted in cooperating, side-to-side association with each other. In addition, each clamping jaw is constructed to be substantially identical to the other clamping jaw, with each clamping jaw incorporating a substantially, semi-circular shaped crimping zone formed in the distal end of the clamping jaw, with each crimping zone being positioned in cooperating association with the crimping zone of the cooperating clamping jaw. In this way, a circular shaped crimping zone is effectively established.

Furthermore, each clamping jaw incorporates a pivot axis defining passageway formed therein, thereby establishing separate pivot axes for each clamping jaw. In order to assure the desired cooperating arcuate pivoting movement of each clamping jaw relative to the adjacent clamping jaw, a linking plate is mounted to each clamping jaw extending from the pivot axis of the first clamping jaw to the pivot axis of the second clamping jaw. In this way, the two clamping jaws are secured and affixed in side-to-side, adjacent relationship, with two separate and independent pivot axes being established and maintained in juxtaposed, spaced, parallel relationship to each other.

Finally, the proximal end of each clamping jaw incorporates a post or strut receiving aperture formed therein and, in the preferred construction, is securely affixed to the stud portion of the connecting post detailed above. In this regard, the stud portion receiving aperture formed in each clamping jaw comprises a longitudinal axis which is parallel to the axis of the pivot defining passageway. As a result of this construction, when each clamping jaw of the jaw head assembly is mounted to one of the connecting posts affixed to the handle members, the clamping jaw head assembly is securely interconnected to the handle members at a substantially perpendicular angle thereto.

As it more fully detailed below, each of the interconnected engagements detailed above, particularly the connecting post engagement with the mounting plates of the handle members and the mounting post engagement to the clamping jaws of the clamping jaw head assembly, are constructed with slip rings mounted between adjacent surfaces for assuring the free pivotable movement of the interconnected components. In this way, assurance is provided that the desired arcuate pivoting movement of the clamping jaws relative to each other is achieved in a smooth, trouble-free operation.

In the alternate preferred embodiment of the present invention, a clamping jaw head assembly is mounted to the handle members in a manner which enables the head assembly to be arcuately pivoted relative to the handle members, while also being securely maintained in the selected position. By employing this construction, the head assembly is able to be placed in any desired arcuate position, in order to achieve a crimping tool assembly which is able to be used in any confined areas with limited or difficult access. In this way, the secure affixation of any crimping ring to pipes, fittings, or other components can be achieved quickly and easily regardless of the location or position of the components to be affixed.

If desired, a variety of alternate constructions can be employed to achieve an effective arcuately pivotable clamping jaw head assembly. However, in order to achieve a crimping tool assembly having the greatest versatility and broad applicability, the preferred construction of the present invention provides a crimping tool assembly wherein the head assembly is arcuately pivotable relative to the handle members through an arcuate distance ranging between about 0° and 90°. Furthermore, although any desired incremental distances can be employed for establishing the alternate positions of the head assembly relative to the handle members, it has been found that incremental positions ranging between about 20° and 25° is preferred.

In the preferred construction of this embodiment of the present invention, each handle member incorporates a support bracket mounted at its proximal end, directly adjacent the flanges which incorporate the pivot defining passageway for enabling the handle members to be arcuately pivotable relative to each other. In the preferred embodiment, each support bracket incorporates a flange portion which is securely mounted to the proximal end of the handle member for pivotal movement relative thereto, while also incorporating a bracket portion defined by two spaced, cooperating wall members. In addition, the flange portion and bracket portion are preferably co-axially aligned to lie in a single plane. Furthermore, each wall member of the bracket portion incorporates a pivot pin receiving aperture, with the two apertures being coaxially aligned.

In addition, each support bracket incorporates a longitudinally extending cavity formed therein which is positioned between the wall members, extending inwardly into the flange portion. As is more fully detailed below, a position defining ball bearing and spring assembly are mounted in the cavity for cooperating relationship with a swivel plate for enabling the clamping jaw head assembly to be arcuately pivotable into the desired angular positions.

In order to enable the clamping jaw head assembly to be arcuately pivotable relative to the handle members, each clamping jaw incorporates a swivel plate mounted to the proximal end of the clamping jaw. In the preferred construction, the swivel plate incorporates a post-member formed at one end thereof which is affixed to the proximal end of the clamping jaw for pivotal movement relative thereto, while also incorporating a substantially flat plate portion dimensioned for being inserted between the wall members of the bracket portion of support the bracket. In addition, the plate portion incorporates a pivot receiving aperture formed therein which is constructed for being cooperatively associated with the pivot receiving apertures of the wall members for securely mounting the plate portion between the wall members for enabling the plate portion to be securely retained between the wall members, while also being arcuately pivotable relative thereto.

In completing the construction of this embodiment of the present invention, the plate portion incorporates a plurality of arcuately curved recess zones formed along the side edge thereof in position for cooperative engagement with the ball bearing and spring lock assembly mounted in the support bracket. By controlling the forces generated by the spring on the ball bearing, the swivel plate is able to be positioned relative to the support bracket in a plurality of alternate angular locations, with the spring and ball bearing engaging the arcuately curved recess zones. As a result, the swivel plate is maintained in any selected position formed by one of the recess zones.

By employing this construction, arcuate pivoting movement of the clamping jaw head assembly is easily achieved by forcing the ball bearing to move against the biasing force of the spring for enabling a particularly desired recess zone to be selected and then enabling the biasing force or the spring to cause the ball bearing to securely engage in the selected recess zones, maintaining the clamping jaw head assembly in the desired position. In this way, any one of a plurality of alternate positions is capable of being quickly and easily achieved for providing a crimping tool assembly which can be used in any desired location.

The invention accordingly comprises the several steps in relation of one or more such steps with respect to each of the others and the article possessing the features, properties, and relation of elements, which are exemplified in the following detailed disclosure, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

DETAILED DESCRIPTION OF THE INVENTION

By referring to FIGS. 1-30, along with the following detailed discussion, the construction and operation of two alternate preferred embodiments of the crimping tool assembly 20 of the present invention can best be understood. In order to provide a full and complete disclosure of the present invention, the two alternate preferred embodiments are fully discussed in detail. However, since alternate constructions and variations can be made without departing from the scope of the present invention, it is to be understood that the following detailed disclosure is provided for exemplary purposes only and is not intended as a limitation of the present invention.

Figure 1:
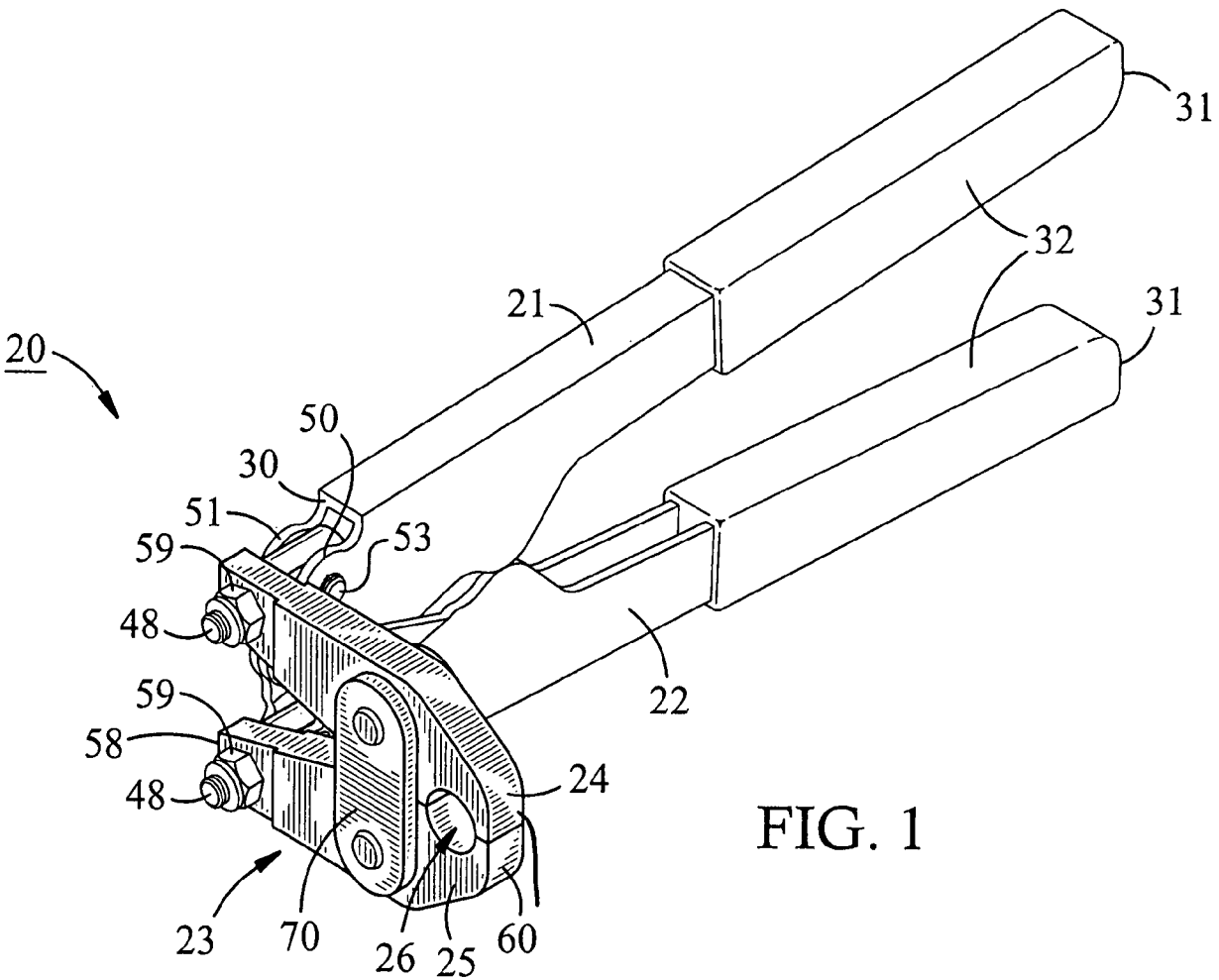
FIG. 1 is a perspective view of one preferred embodiment of the crimping tool assembly of the present invention depicting the clamping jaw head assembly mounted at right angles to the handle members.
Figure 2:
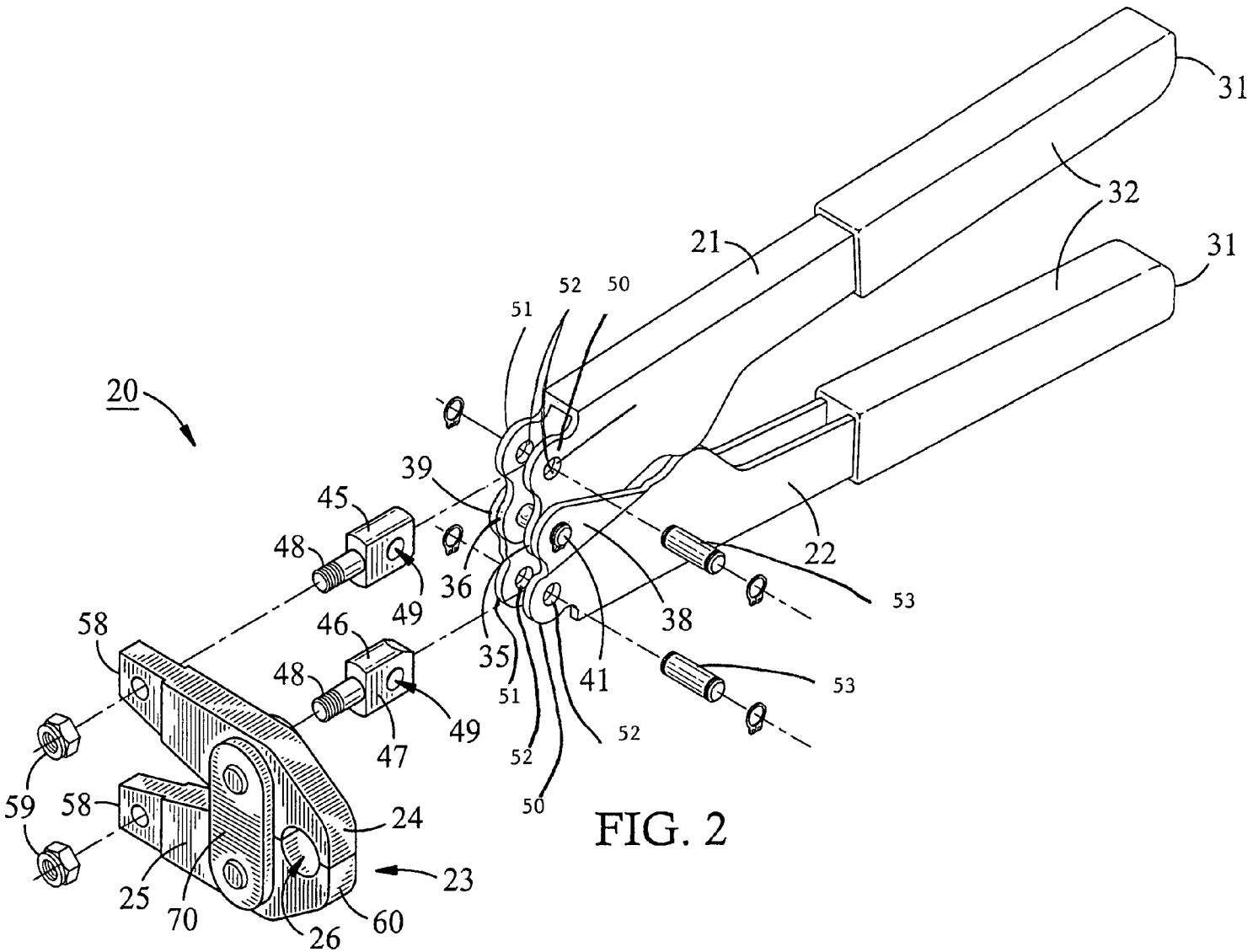
FIG. 2 is an exploded perspective view of the crimping tool assembly of FIG. 1.
Figure 3:
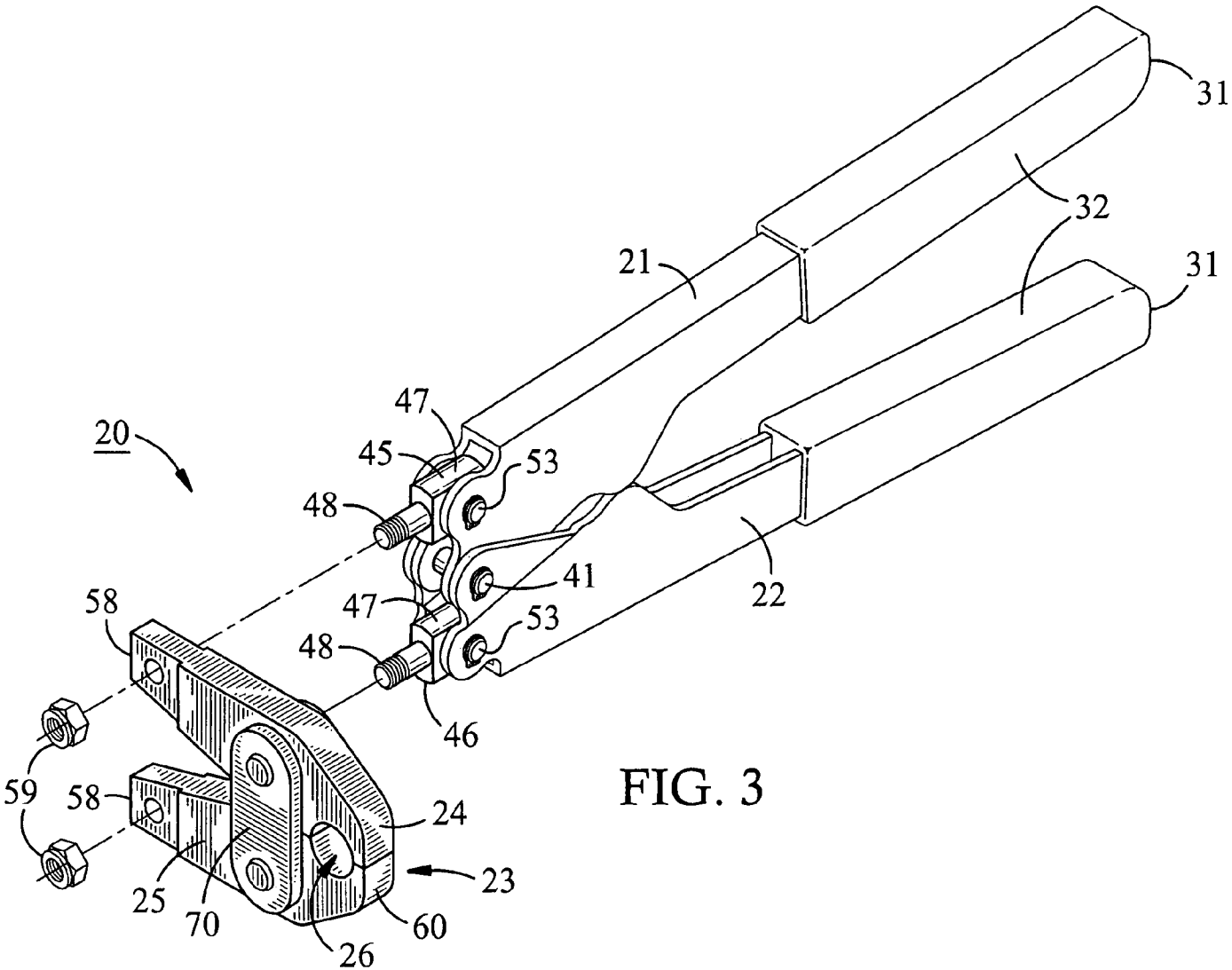
FIG. 3 is a partially exploded perspective view of the crimping tool assembly of FIG. 1.
Figure 4:
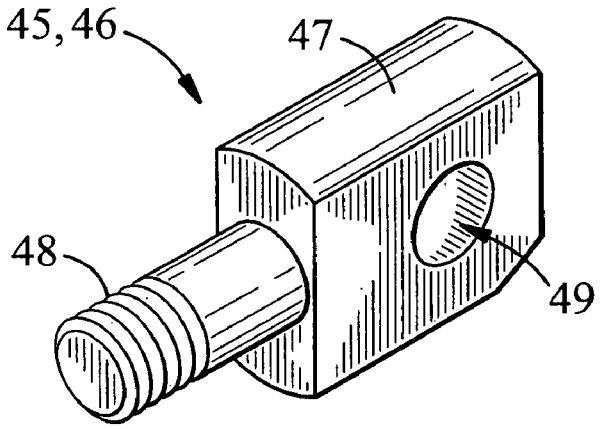
FIG. 4 is a perspective view of the mounting post employed in constructing the crimping tool assembly of FIG. 1.
Figure 5:
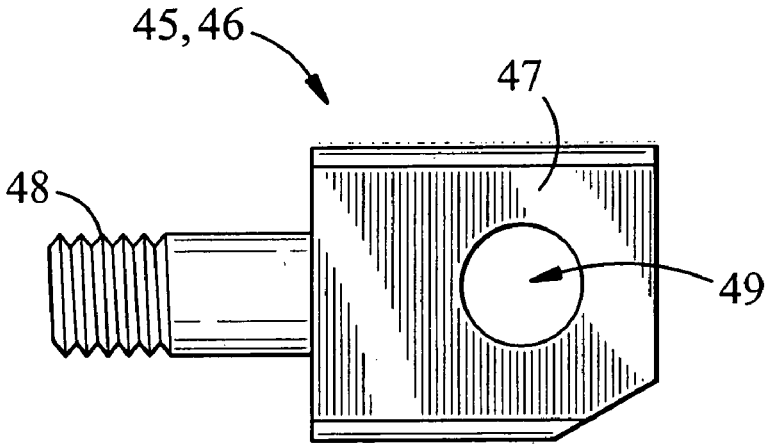
FIG. 5 is a side elevation view of the mounting post of FIG. 4.
Figure 6:
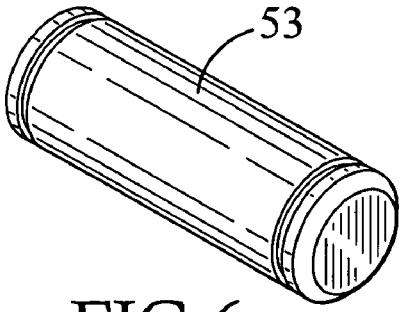
FIG. 6 is a perspective view of the cylindrically shaped pin or rod employed for securing the mounting post to the handle members of the crimping tool of FIG. 1.

As the best seen in FIGS. 1-3, the first preferred embodiment of crimping tool assembly 20 comprises handle members 21 and 22 in combination with clamping jaw head assembly 23. As depicted, and fully detailed below, clamping jaw head assembly 23 incorporates clamping jaws 24 and 25, which are mounted to each other for arcuate pivoting movement about two separate and independent pivot axes. In addition, clamping jaws 24 and 25 cooperate with each other to form a crimping zone 26 which is employed for peripherally surrounding the desired ring to be crimped to the pipes, fittings, or other components, and enabling the clamping forces to be applied to the ring for securely clampingly engaging the desired components to each other.

In the preferred construction of this embodiment of the present invention, handle members 21 and 22 each comprise elongated, longitudinally extending arm members having proximal ends 30 and distal ends 31. In addition, gripping covers 32 are mounted to distal ends 31 of handle members 21 and 22, longitudinally extending therefrom along a major portion of the length of handle members 21 and 22. In this way, operational ease and comfort are provided.

In order to provide the desired controlled, compound pivot axis movement of clamping jaws 24 and 25, while also providing a construction which enables the forces applied to handle members 21 and 22 to be substantially enhanced and concentrated for assuring that a sufficient force is delivered to crimping zone 26, handle members 21 and 22 are constructed for being arcuately pivotable relative to each other. In this regard, handle member 21 comprises a pair of flanges 35 and 36 formed at its proximal end 30, with flanges 35 and 36 being positioned in juxtaposed, spaced relationship with each other. In addition, flanges 35 and 36 each incorporate a pivot axis defining aperture formed therein, with the pivot axis defining apertures of flanges 35 and 36 being aligned with each other.

Similarly, handle member 22 comprises a pair of flanges 38 and 39 formed at its proximal end, with flanges 38 and 39 being positioned in juxtaposed, spaced relationship with each other. In addition, flanges 38 and 39 each incorporate a pivot axis defining aperture formed therein, with the pivot axis defining apertures of flanges 38 and 39 being aligned with each other.

In order to provide the desired cooperating, arcuate pivoting movement of handle members 21 and 22, flanges 35 and 36 of handle member 21 are positioned in cooperating association with flanges 38 and 39 of handle member 22 for enabling the flanges to be in overlying, vertically aligned relationship with each other, with the pivot axis defining apertures thereof also being aligned. In order to complete the construction, cylindrically shaped pin or rod 41 is positioned the pivot axis defining apertures and securely mounted thereto, affixing flanges 35, 36, 38, and 39 together, while also enabling handle members 21 and 22 to be arcuately pivotable relative to each other about the axis defined by pin or rod 41.

As discussed above, one of the unique aspects of the construction of this embodiment of crimping tool assembly 20 is the affixation of clamping jaw head assembly 23 to handle members 21 and 22 at substantially right angles thereto. In order to achieve this construction, as best seen in FIGS. 1-6, crimping tool assembly 20 incorporates mounting or connecting posts 45 and 46, each of which are separately secured to handle members 21 and 22. As depicted, connecting post 45 is mounted to proximal end 30 of handle member 21 directly between adjacent flanges 35 and 36. Similarly, connecting post 46 is mounted to proximal end 30 of handle member 22 directly between adjacent flanges 38 and 39.

In the preferred construction, each connecting post 45 and 46 comprises block portion 47 and threaded stud portion 48. In addition, each block portion 47 incorporates aperture 49 which extends therethrough and forms the pivot axes for connecting posts 45 and 46.

Furthermore, in order to pivotally affix connecting posts 45 and 46 to handle members 21 and 22, handle members 21 and 22 each comprise a pair of holding flanges or plates 50 and 51 which are mounted in juxtaposed, spaced, cooperating relationship with each other at proximal end 30 thereof. In addition, holding flanges or plates 50 and 51 incorporate aperture 52 which is constructed for aligned, cooperative relationship with aperture 49 of block portion 47 of connecting post 45 and 46. In order to provide the desired pivotal mounted engagement of connecting post 45 and 46 with handle members 21 and 22, block portions 47 are positioned between holding flanges or plates 50 and 51, and cylindrically shaped pin or rod 53 is positioned extending through apertures 49 and 52 and secured in position for enabling connecting posts 45 and 46 to be pivotal relative to handle members 21 and 22.

As depicted, threaded stud portions 48 of connecting posts 45 and 46 extend longitudinally from block portion 47, preferably being co-axially aligned therewith. In addition, as more fully detailed below, threaded stud portions 48 of connecting posts 45 and 46 are constructed for engagement with clamping jaws 24 and 25 of clamping jaw head assembly 23 in order to position and maintain clamping jaw head assembly 23 at the desired fixed angular relationship relative to handle members 21 and 22.

In order to achieve the desired construction for the first preferred embodiment of the present invention, each clamping jaw 24 and 25 comprises stud receiving aperture 57 formed in proximal end 58, as shown in FIGS. 1-3 and 7-9. Preferably, stud receiving apertures 57 are constructed with a central axis which is substantially parallel to the central axis of crimping zone 26. In this way, when clamping jaw head assembly 23 is mounted to threaded stud portions 48 of connecting post 45 and 46, clamping jaw head assembly 23 is positioned and maintained in a plane which is substantially perpendicular to the plane within which handle members 21 and 22 are maintained. As a result, the desired right angular configuration sought for this preferred embodiment of the present invention is achieved.

In order to securely affix clamping head assembly 23 to handle members 21 and 22, threaded stud portions 48 are telescopically advanced through apertures 57 of clamping jaws 24 and 25, and locking nuts 59 are securely affixed to the terminating threaded end of stud portions 48. In this way, the mounted engagement of threaded stud portions 48 to clamping jaws 24 and 25 is achieved in a manner which enables clamping jaws 24 and 25 to be arcuately pivoted in response to the movement of handle member 21 and 22. As a result, the desired arcuate pivotal movement of clamping jaws 24 and 25 is achieved.

In the preferred construction, clamping jaw 24 comprises distal end 60 with at least one curved recess zone 64 formed therein adjacent distal end 60. Similarly, clamping jaw 25 comprises at least one arcuately curved recess zone 65 formed adjacent distal end 60 thereof.

Preferably, curved recess zones 64 and 65 comprises semicircular shapes and are pre-positioned for cooperative aligned relationship with each other to form crimping zone 26 when clamping jaws 24 and 25 are mounted together to form clamping jaw head assembly 23.

Furthermore, recess zones 64 and 65 are preferably constructed with smooth, toothless surfaces in order to produce a crimped element which is free of any grooves, marks, dimples and the like. However, if desired, recess zones 64 and 65 may incorporate a raised portion or tooth element which produces a depression, channel, or ring shape on the crimped element.

In addition, in order to provide a compound pivot axis construction and enable clamping jaw head assembly 23 to produce increased clamping forces in crimping zone 26, clamping jaw 24 comprises a pivot axis defining aperture formed therein and positioned between distal end 60 and proximal end 58. Similarly, clamping jaw 25 comprises a pivot axis defining aperture formed therein, between distal end 60 and proximal end 58. In addition, in the preferred construction, the axes defined by the pivot axis defining apertures are parallel to each other, while also being parallel to the axes defined by stud receiving apertures 57 and crimping zone 26.

Figure 7:
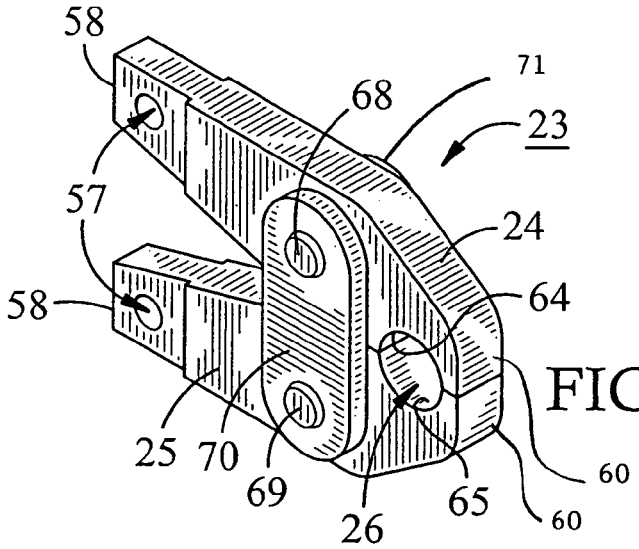
FIG. 7 is a perspective view of one embodiment of the clamping jaw head assembly of the present invention.
Figure 8:
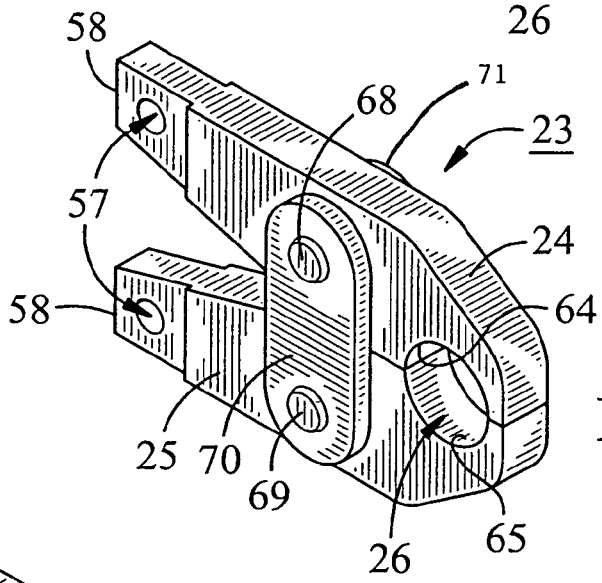
FIG. 8 is a perspective view of an alternate embodiment of the clamping jaw head assembly of the present invention.
Figure 9:
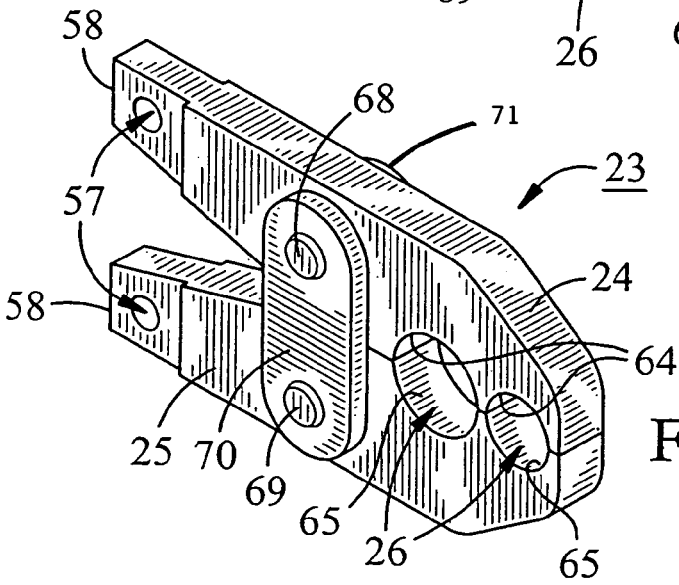
FIG. 9 is a still further alternate embodiment of the clamping jaw head assembly of the present invention.

By employing this construction, the desired dual axis, compound pivot configuration is achieved for clamping jaw head assembly 23, while also enabling head assembly 23 to be mounted to handle members 21 and 22 at substantially right angles to each other. Furthermore, by controlling the spaced distance between the pivot axis defining apertures and crimping zone 26, the force generated by clamping jaws 24 and 25 in crimping zone 26 is controlled. Also, as shown in FIGS. 7-9, crimping zone 26 may comprise any desired diameter as well as having multiple crimping zones 26 formed therein.

In order to assure that clamping jaws 24 and 25 cooperate with each other to produce the desired crimping force in crimping zone 26, clamping jaws 24 and 25 are mounted in side to side relationship, with linking or tie plates 70 and 71 extending between clamping jaws 24 and 25. In the preferred construction, cylindrically shaped mounting pin or rod 68 is mounted to clamping jaw 24, extending through its pivot defining aperture and connecting tie plates 70 and 71 to the opposite surface of jaw 24. Similarly, pin or rod 69 extends through its pivot defining aperture of clamping jaw 25 affixing tie plates 70 and 71 to the opposed surfaces of jaw 25.

In addition to securing tie plates 70 and 71 to the surfaces of clamping jaws 24 and 25, pins or rods 68 and 69 establish the pivot axis for enabling jaws 24 and 25 to operate. Furthermore, pins or rods 68 and 69, along with tie plates 70 and 71 assure that clamping jaws 24 and 25 are securely mounted to each other to form clamping jaw head assembly 23 while also providing the desired cooperating and controlled movement.

By employing this preferred embodiment of the present invention, a unique crimping tool assembly 20 is realized, wherein clamping jaw head assembly 23 is maintained at about 90° relative to handle members 21 and 22. As a result, crimping tool assembly 20 can be easily used in small, confined areas in which prior art constructions were virtually impossible to be used.

Figure 10:
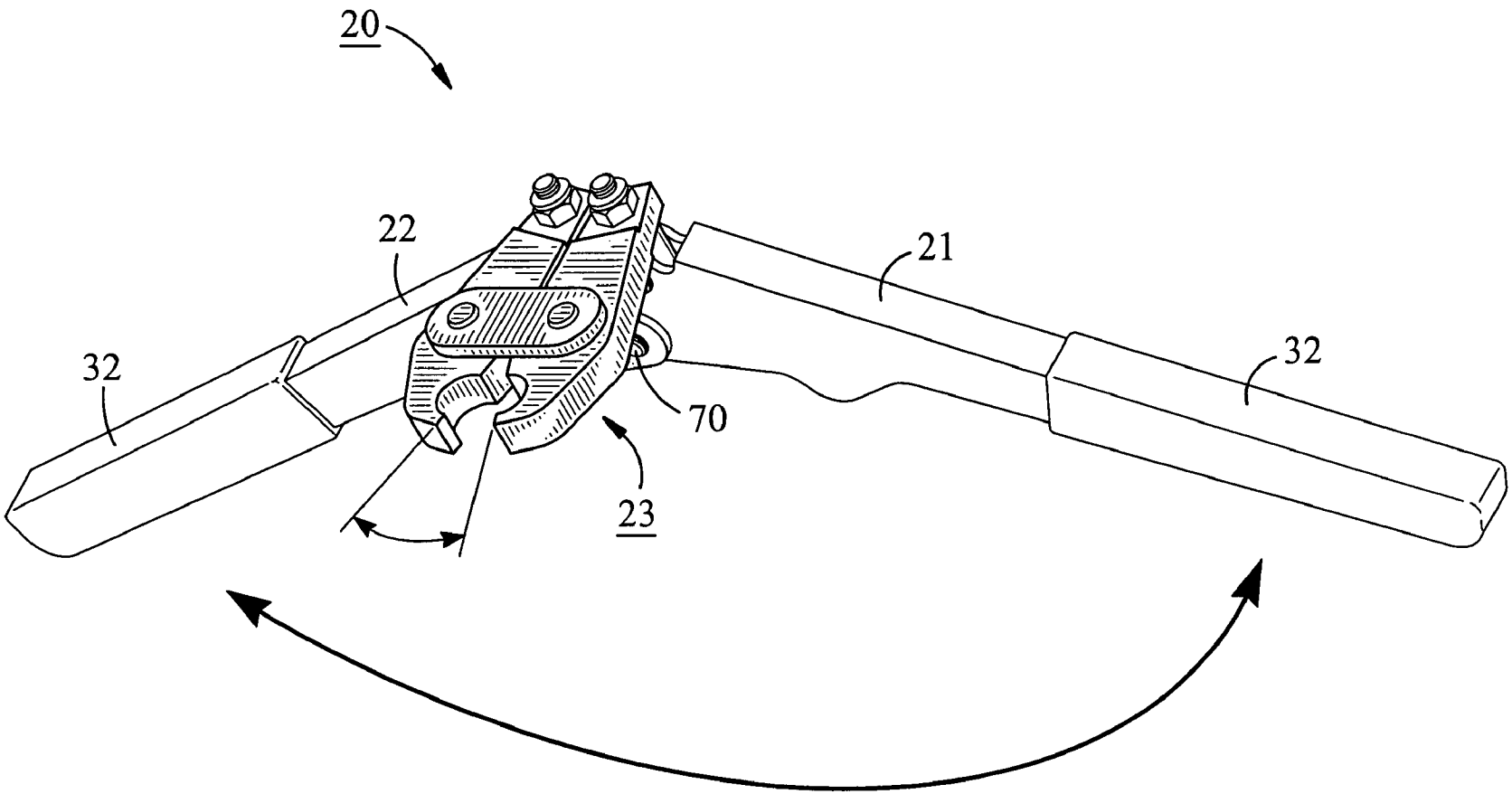
FIG. 10 is a perspective view of the fully assembled crimping tool assembly of FIG. 1 shown in the open position.
Figure 11:
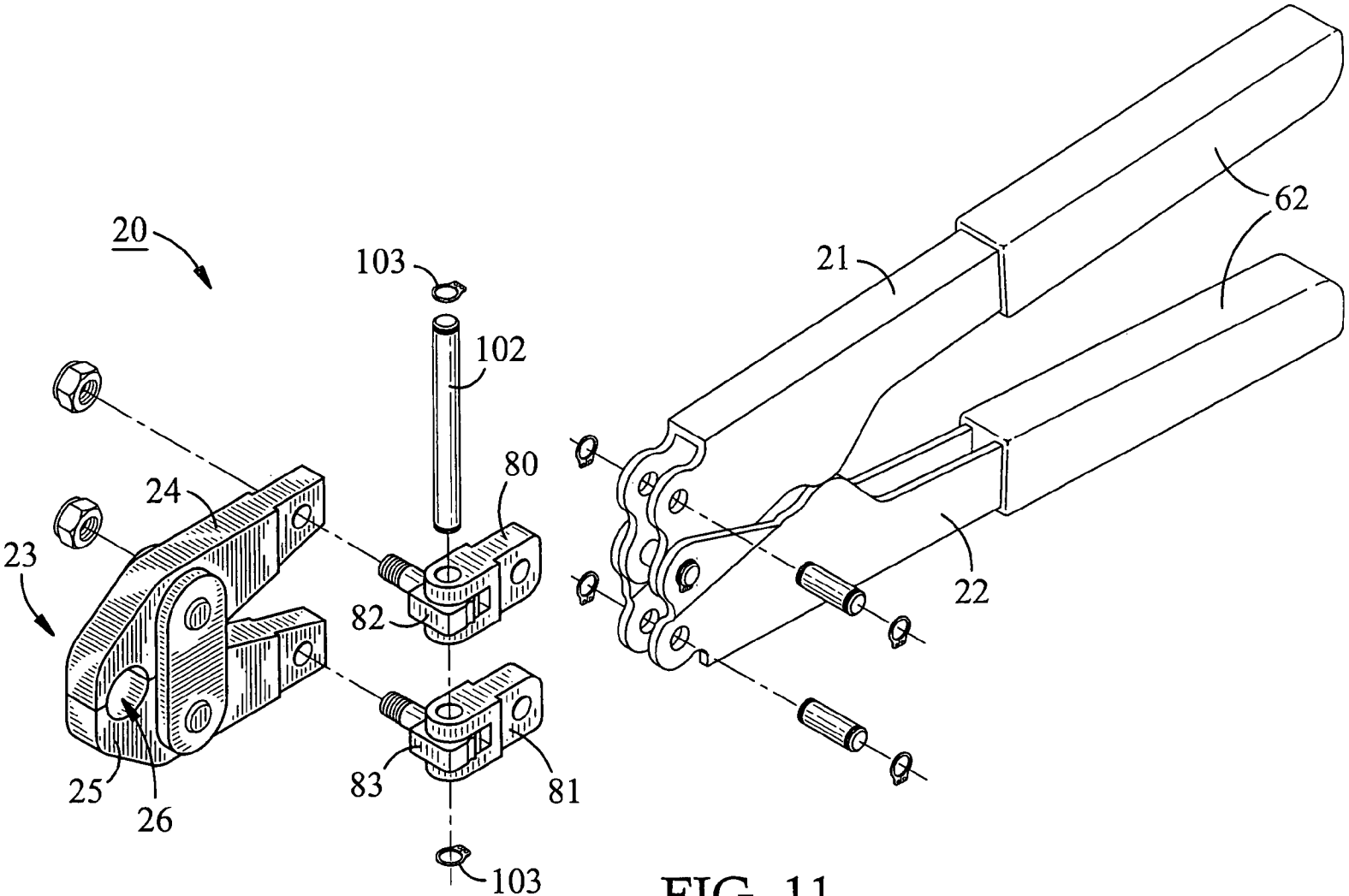
FIG. 11 is an exploded perspective view of a second preferred embodiment of the crimping tool assembly of the present invention depicting the clamping jaw head assembly constructed for being arcuately pivotable relative to the handle members.
Figure 12:
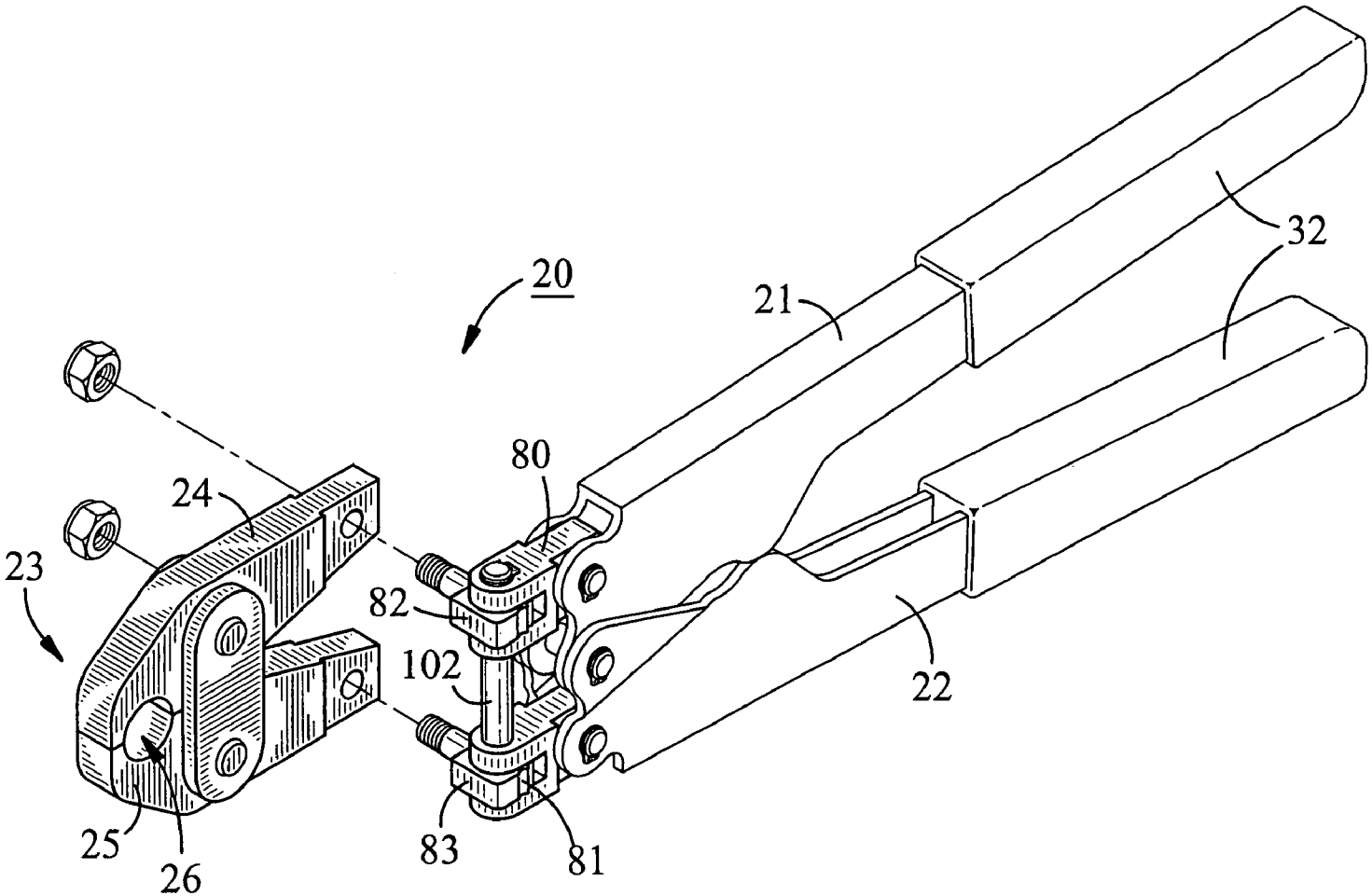
FIG. 12 is a partially exploded perspective view of the crimping tool assembly of FIG. 11.
Figure 13:
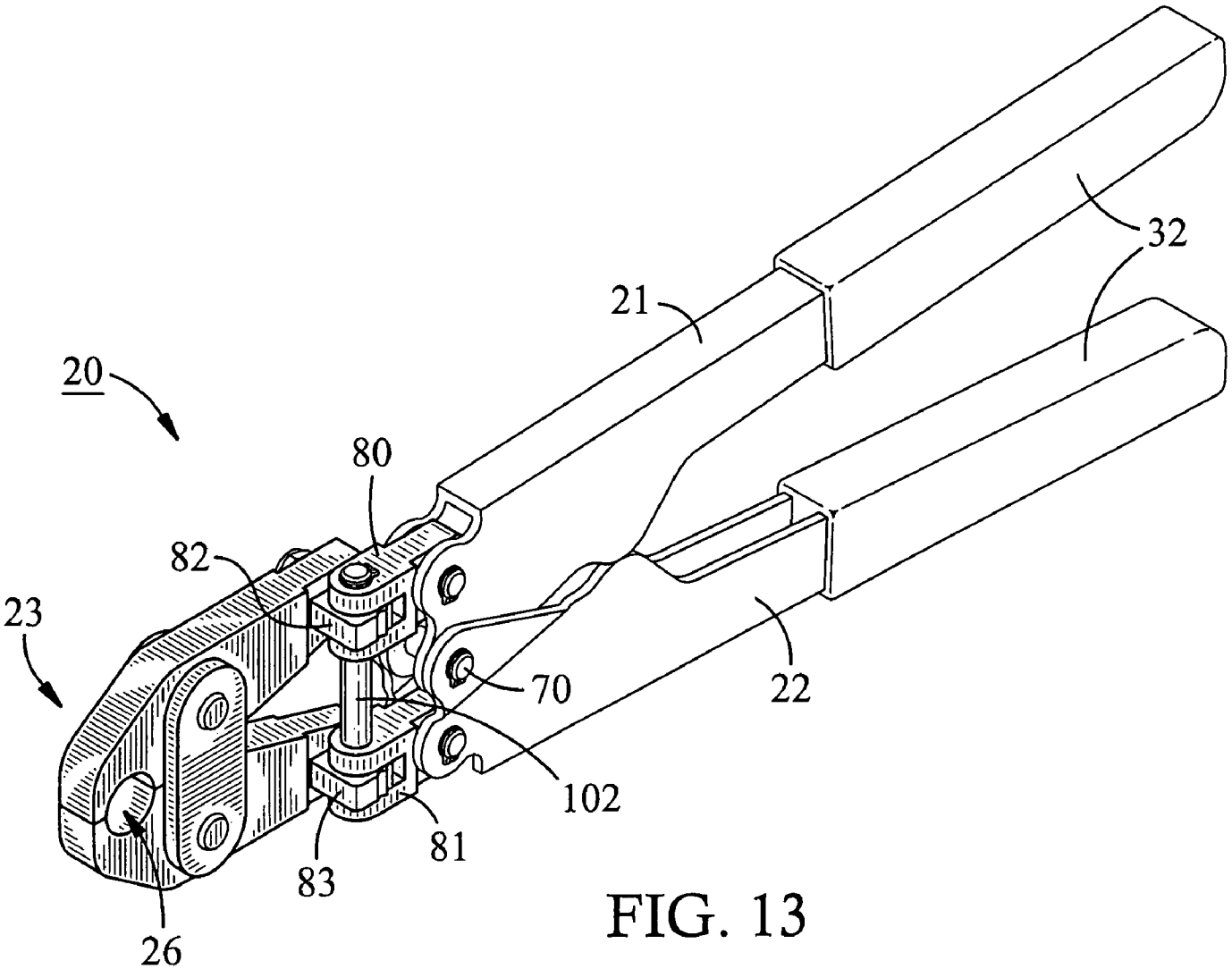
FIG. 13 is a perspective view of the completely assembled crimping tool assembly of FIG. 11.
Figure 14:
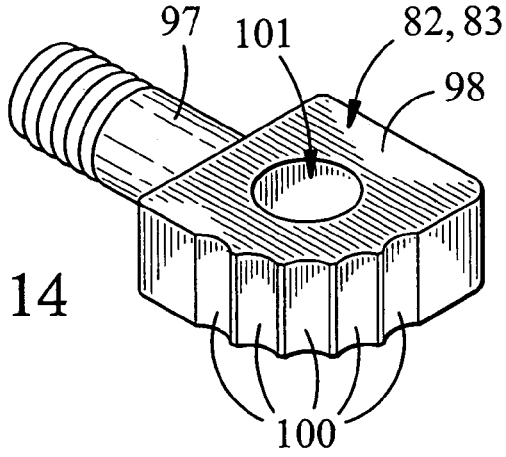
FIG. 14 is a perspective view of the swivel plate employed in constructing the crimping tool assembly of FIG. 11.
Figure 15:
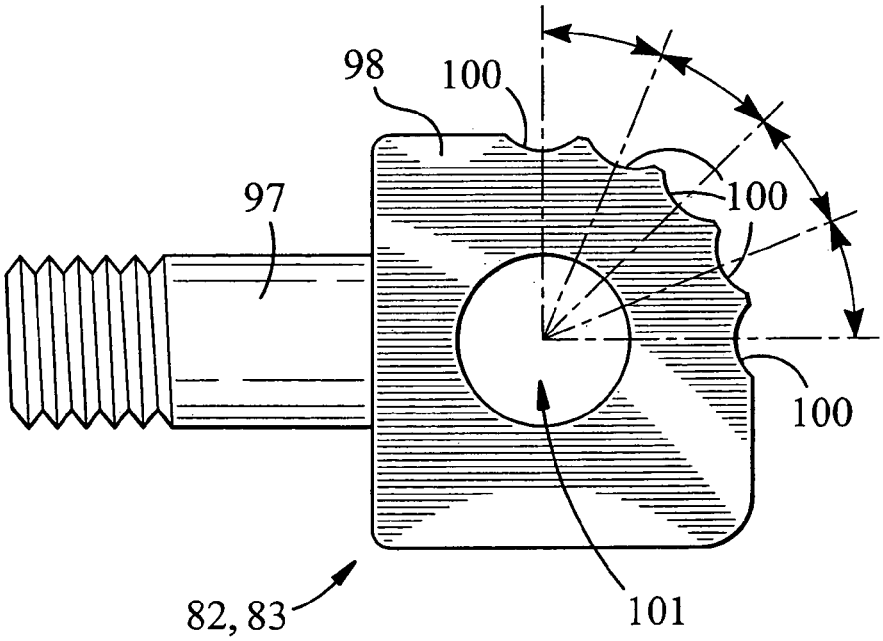
FIG. 15 is a side elevation view of the swivel plate of FIG. 14.
Figure 16:
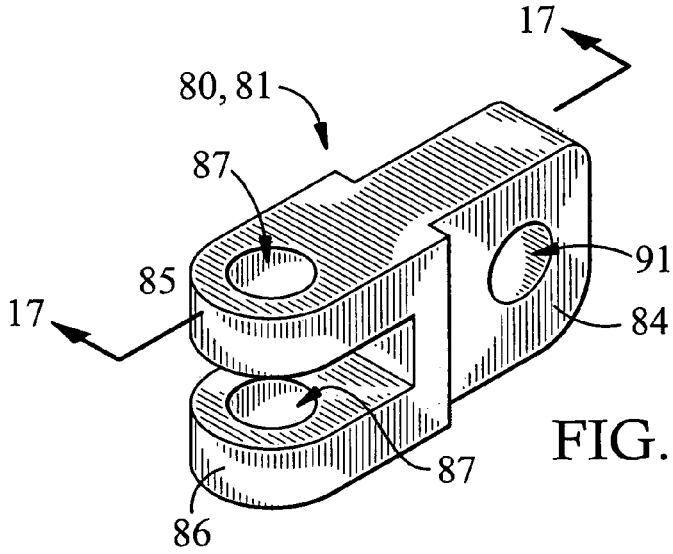
FIG. 16 is a perspective view of the support bracket employed in constructing the crimping tool assembly of FIG. 11.
Figure 17:
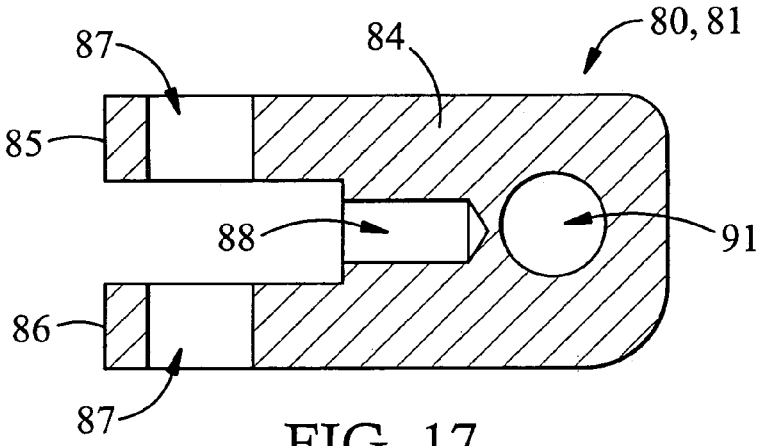
FIG. 17 is a cross-sectional side elevation view of the support bracket taken along the 17-17 line of FIG. 16.
Figure 18:
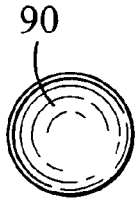
FIG. 18 is a plan view of a ball bearing employed in the support bracket of FIG. 16.
Figure 19:
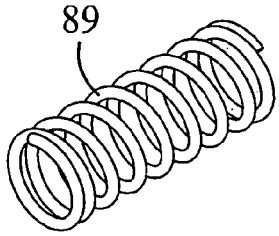
FIG. 19 is a perspective view of a spring member employed in constructing the bracket of FIG. 16.
Figure 20:
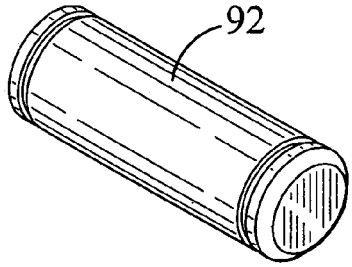
FIG. 20 is a perspective view of a pin or rod employed in securing the support bracket to the handle members of the crimping tool assembly of FIG. 11.
Figure 21:
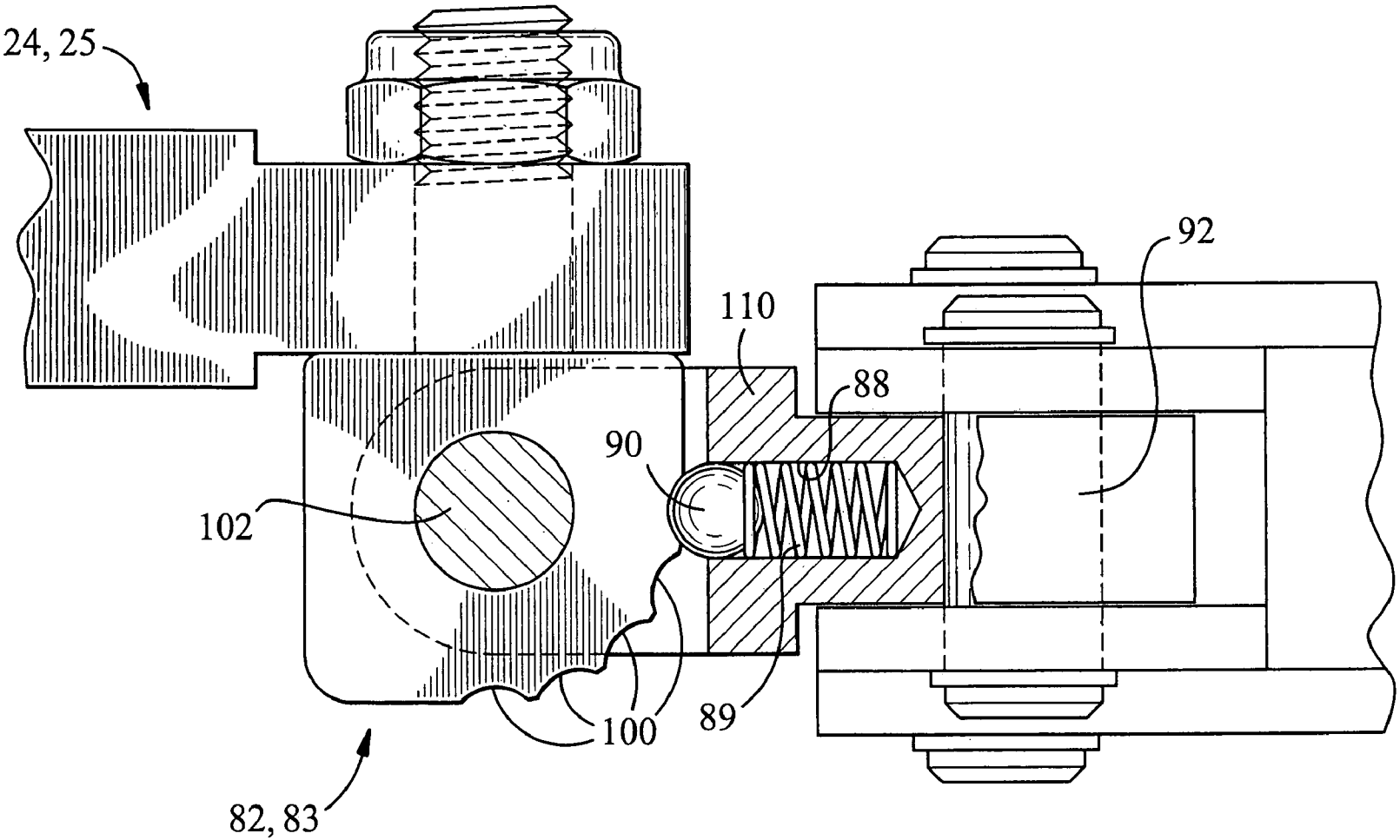
FIG. 21 is an enlarged side elevation view, partially in cross-section and partially broken away, depicting the mounted interconnected engagement of the clamping jaw head assembly to the handle member employing the swivel plate and support bracket for constructing the crimping tool assembly of FIG. 11.
Figure 22:
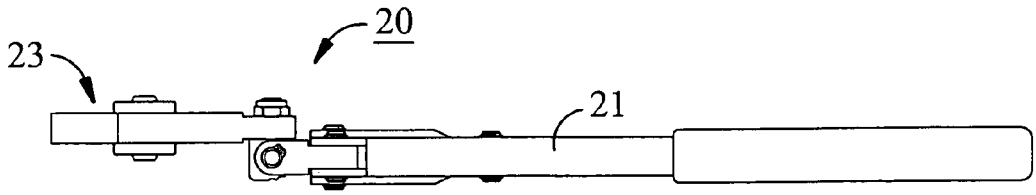
FIGS. 22-26 are side elevation views depicting the alternate angular positions in which the clamping jaw head assembly is capable of being positioned relative to the handle members in the crimping tool assembly of FIG. 11.
Figure 23:
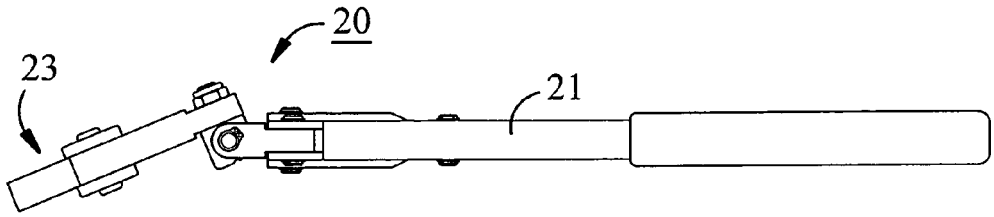
Figure 24:
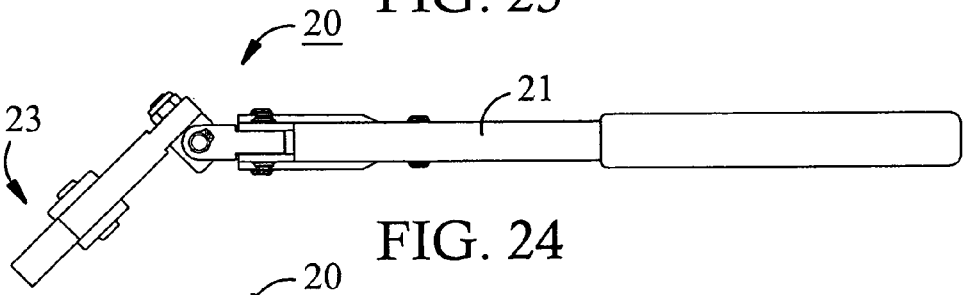
Figure 25:
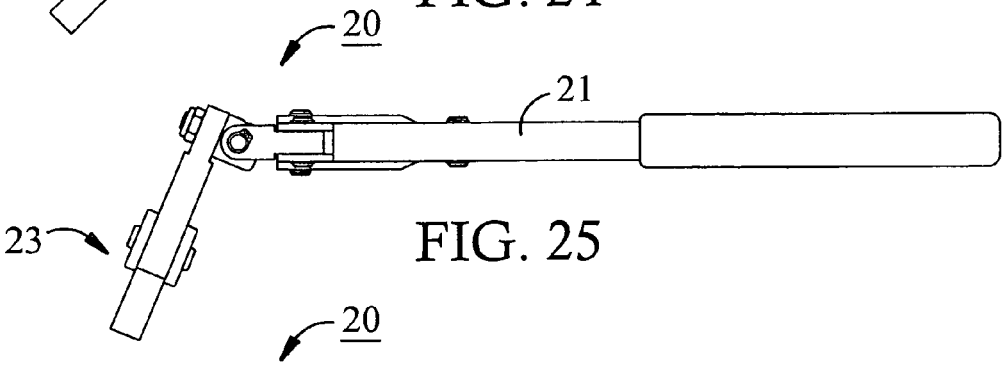
Figure 26:
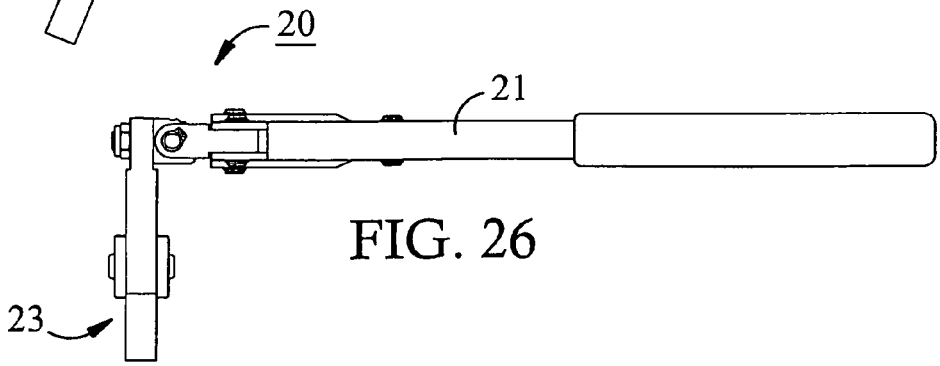
Figure 27:
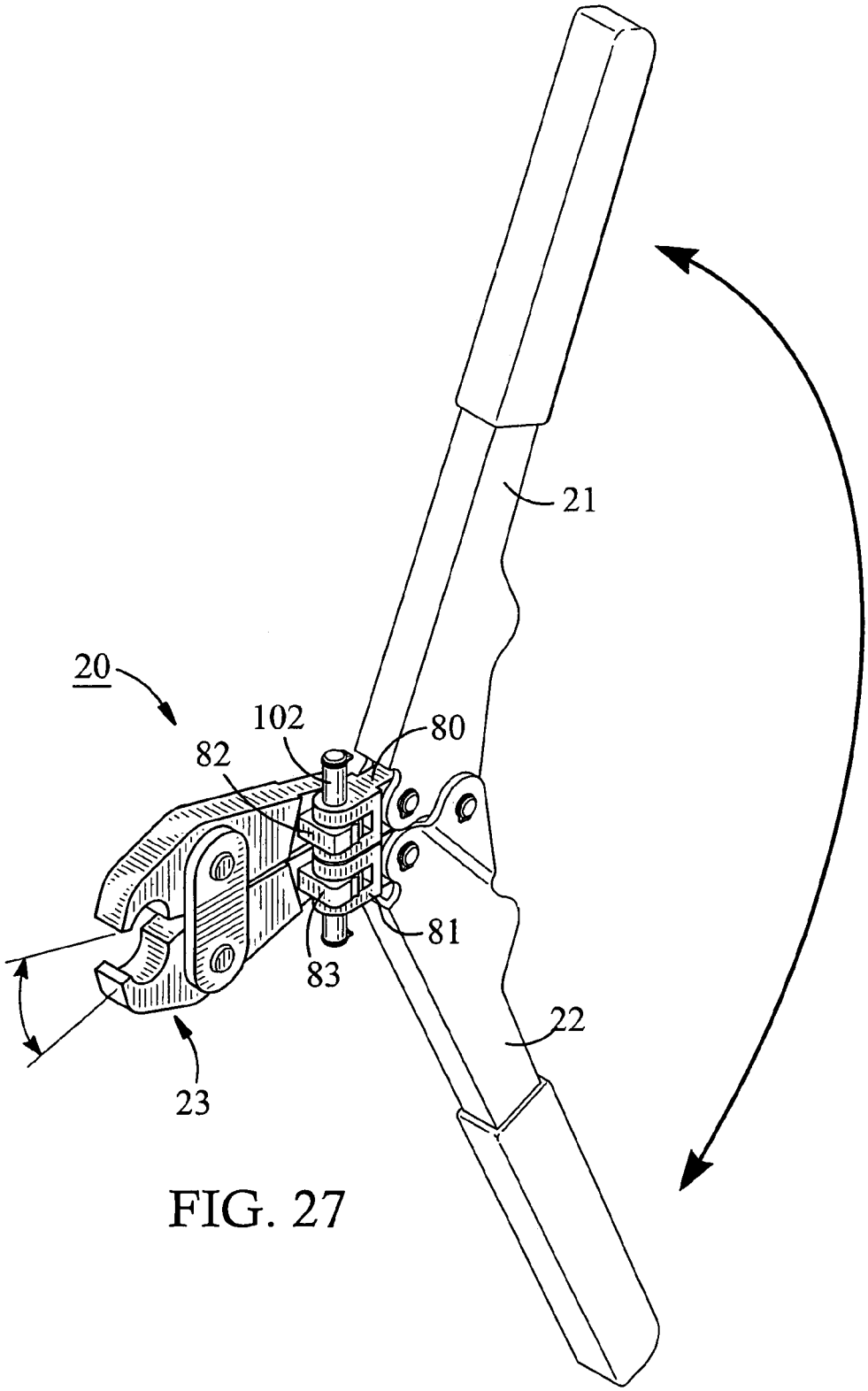
FIG. 27 is a perspective view of the crimping tool assembly of FIG. 11 shown in the open position with the clamping jaw head assembly lying in substantially the same plane as the handle members.
Figure 28:
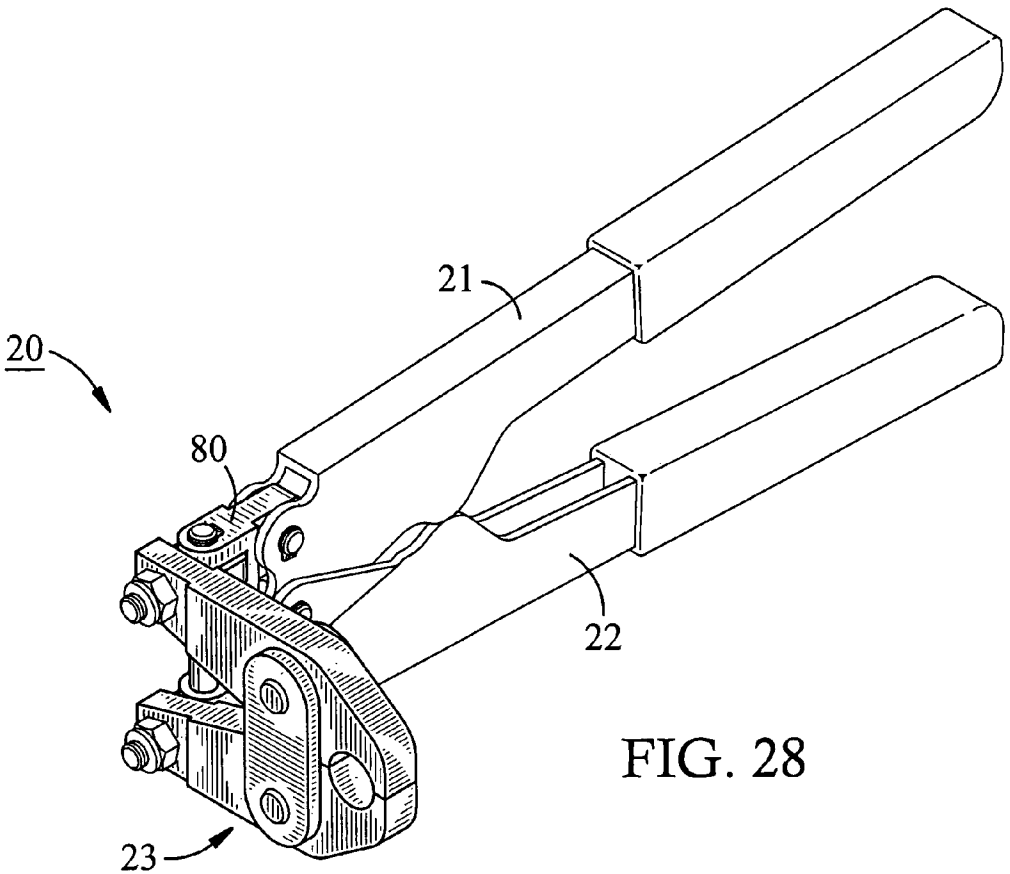
FIG. 28 is a perspective view of the crimping tool assembly of FIG. 11 shown in the closed position with the clamping jaw head assembly lying in a plane substantially perpendicular to the plane of the handle members.
Figure 29:
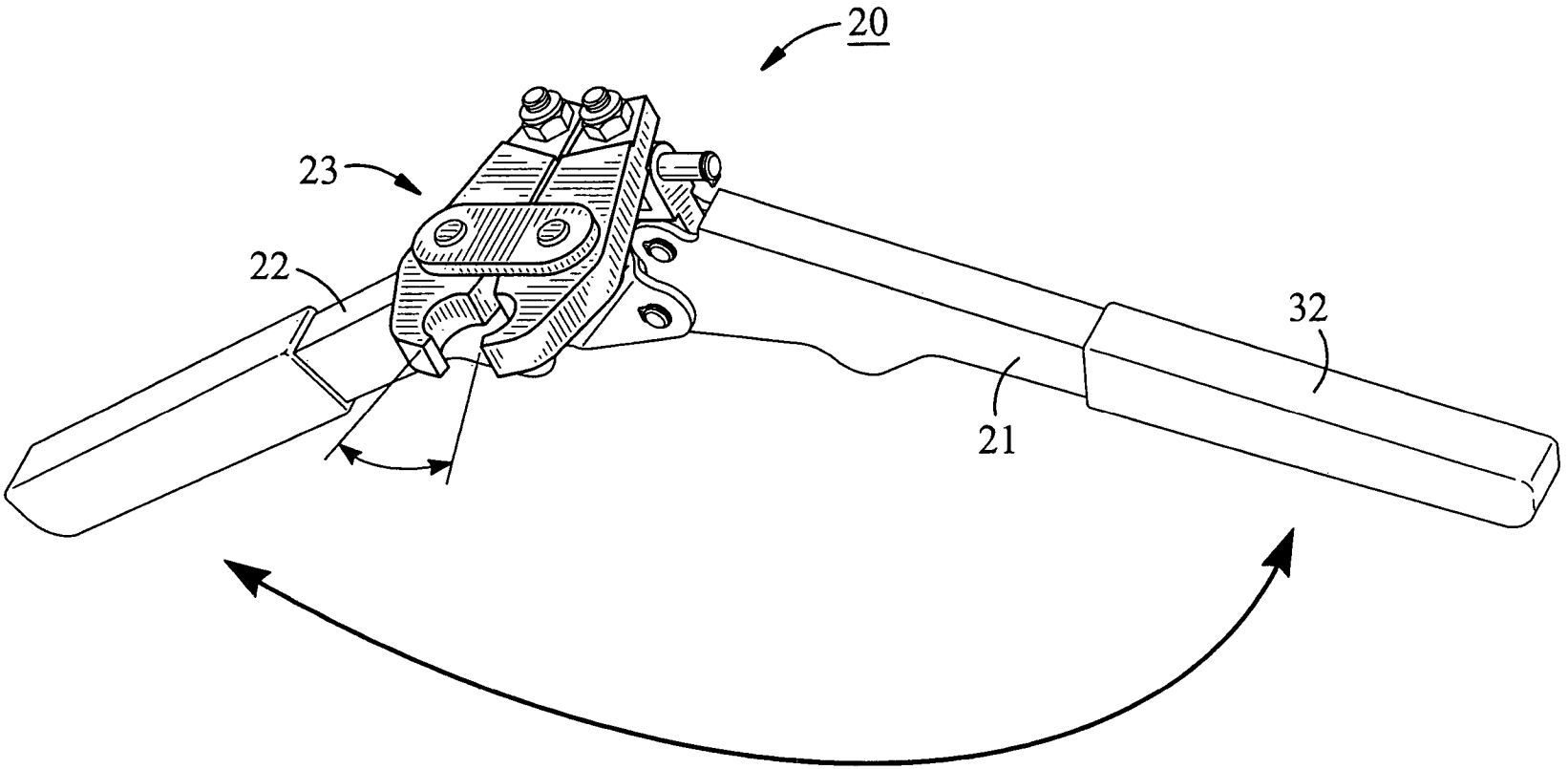
FIG. 29 is a perspective view of the crimping tool assembly of FIG. 28 shown in the open position.
Figure 30:
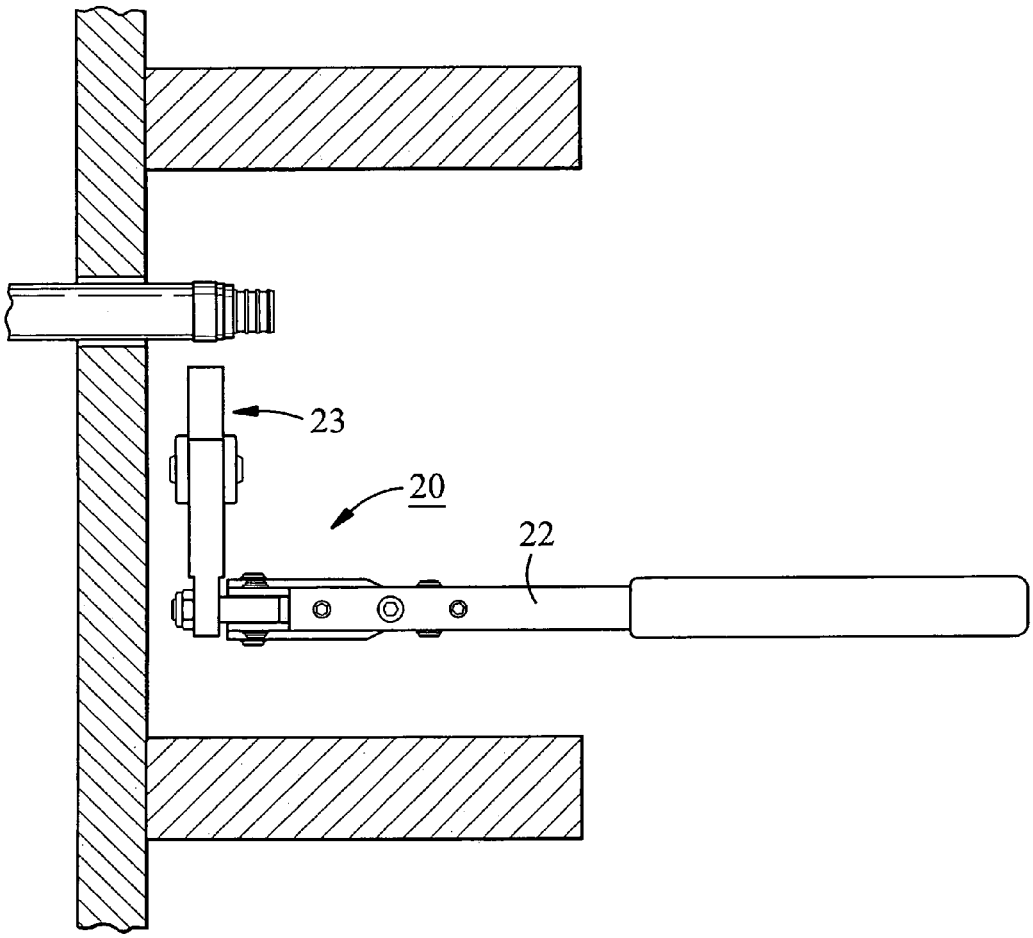
FIG. 30 is a side elevation view partially in cross-section, depicting the crimping tool assembly of the present invention in use in a confined area.

Furthermore, as shown in FIG. 10, by arcuately moving handle members 21 and 22 in opposite directions, clamping jaws 24 and 25 are moved away from each other, with clamping jaw 23 moving about the axis defined by pin or rod 68, while clamping jaw 24 pivots about the axis defined by pin/rod 69. In this way, crimping zone 26 is opened to enable the desired ring to be inserted therein.

In addition, once a ring is inserted into crimping zone 26, handle members 21 and 22 are pivoted toward each other, causing clamping jaws 24 and 25 to pivot from the position shown in FIG. 10 into the position shown in FIG. 1, effectively causing the ring to be compressed, squeezed and crimped into secure, mounted engagement with the desired pipes and/or fitting for achieving the required interengagement of the components. Furthermore, due to the multi-axis, compound pivoting construction achieved by the present invention, the force applied by the user on handle members 21 and 22 are effectively and efficiently multiplied to produce a substantially increased crimping force on the ring placed in crimping zone 26. As a result, ease of operation and use are realized.

In FIGS. 11-30, the second preferred embodiment of the present invention is fully depicted. In this embodiment, handle members 21 and 22, as well as clamping jaw head assembly 23 are constructed in a manner substantially identical to the construction detailed above. However, in the second preferred embodiment, clamping jaw head assembly 23 is affixed to handle members 21 and 22 in a manner which enables clamping jaw head assembly 23 to be arcuately movable relative to handle members 21 and 22, while also being securely positioned in a plurality of alternative angular orientations. In this way, crimping tool assembly 20 is substantially enhanced and able to be used easily and conveniently in a wide variety of locations and applications.

As best seen in FIGS. 11-21, clamping jaw head assembly 23 is able to be arcuately pivoted relative to handle members 21 and 22 by employing support brackets 80 and 81 in combination with swivel plates 82 and 83. In the preferred construction, support brackets 80 and 81 each comprise flange or block portion 84 and cooperating wall portions 85 and 86. As depicted, wall portions 85 and 86 are formed in cooperating aligned relationship with each other and incorporate a pivot pin receiving aperture 87, which are aligned with each other.

Support brackets 80 and 81 also incorporate a longitudinally extending cavity formed therein, extending into block position 84 between wall portions 85 and 86. As is more fully detailed below, cavity 88 is employed for housing biasing spring 89 and ball bearing 90, which are employed to control the accurate pivoting movement of the clamping jaw head assembly.

In the preferred construction, block portion 84 of each support bracket 80 and 81 incorporates a cavity 91 which is employed for maintaining support brackets 80 and 81 to the proximal end 30 of handle members 21 and 22. In this regard, pin or rod 92 is employed and is secured to holding flanges or plates 50 and 51 of arm members 21 and 22, in a substantially identical manner as detailed above.

With support brackets 80 and 81 longitudinally extending from handle members 21 and 22, the clamping jaw head assembly is constructed with swivel plates 82 and 83 mounted thereto. Preferably, swivel plates 82 and 83 are constructed with threaded post member 97 formed on one end thereof and plate portion 98 formed on the other end thereof. In addition, plate portion 98 incorporates a plurality of arcuately curved recess zones 100 formed therein which provides the alternate angular positions for clamping jaw head assembly 23 relative to handle members 21 and 22.

In order to secure clamping jaw head assembly 23 to handle members 21 and 22, post member 97 of swivel plate 82 is inserted in cavity 57 of clamping jaw 24 and secured thereto by lock nut 99. Similarly, post member 97 of swivel plate 83 is inserted into cavity 57 of clamping jaw 25 and secured thereto by lock nut 99.

The interconnected engagement of clamping jaw head assembly 23 with handle members 21 and 22 is completed by placing plate portion 98 of each swivel plate 82 and 83 between wall portions 85 and 86 of support brackets 80 and 81. In this regard, arcuately curved recess zones 100 of plate portions 98 are positioned in cooperating alignment with ball bearing 90 and spring 89 for enabling clamping jaw head assembly to be lockingly positioned in any desired angular position provided by curved recess zones 100.

In the preferred construction, plate portion 98 incorporates five arcuately curved recess zones 100, each of which are spaced equally from an adjacent recess zone. In addition, recess zones 100 preferably define a 90° arc in their entirety. As a result, each recess zone 100 is spaced at an arcuate distance of 22.5° from an adjacent zone 100, enabling clamping jaw head assembly to be placed in five alternate locations ranging from 0°, 22.5°, 45°, 77.5° to 90°. In this way, virtually any desired orientation or position is easily achieved for enabling this embodiment of crimping tool assembly 20 to be used in any location.

In order to assure that clamping jaw head assembly is quickly and easily placed in any desired alternative position, plate portions 98 of swivel plates 82 and 83 incorporate apertures 101 and are placed between wall portions 85 and 86 of support brackets 80 and 81. Furthermore, elongated rod 102 is inserted through aperture 93 formed in wall portions 85 and 86, capturing plate portion therebetween and extending from support bracket 80 to support bracket 81. In this way, a single, continuous, elongated rod extends from support bracket 80 to support bracket 81, being held in place by lock ring 103.

As a result of this construction, clamping jaw head assembly 23 is easily arcuately pivoted about the axis defined by elongated rod or beam 102, enabling ball bearing 90 to be moved into and out of engagement in each arcuately curved recess zone 100. Once the desired angular position of clamping jaw head assembly 23 relative to handle members 21 and 22 is attained, the forces generated by spring 89 cause ball bearing 90 to lockingly engage the selected recess zone 100, assuring clamping jaw head assembly 23 is maintained in the desired angular relationship with handle member 21 and 22.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. A crimping tool constructed for securely affixing a cylindrical ring about a cylindrical pipe and overlying connecting tube, said tool comprising:

A. a first elongated handle incorporating a proximal end and a distal end;

B. a second elongated handle incorporating a proximal end and a distal end;

C. said first elongated handle and said second elongated handle being pivotally interconnected to each other adjacent their respective proximal ends at a center pivot axis for enabling the proximal end of the first elongated handle and the proximal end of the second elongated handle to move in an arcuate direction in response to the arcuate movement of the distal ends of the first and second elongated handles;

D. a clamping jaw assembly comprising a) a first clamping jaw incorporating a proximal end and a distal end, b) a second clamping jaw incorporating a proximal end and a distal end, c) said first clamping jaw and said second clamping jaw comprising substantially identical constructions and being mounted in juxtaposed, spaced, adjacent, side to side cooperating relationship with each other, d) said first clamping jaw comprising a first crimping zone formed by an arcuately shaped recess formed adjacent the distal end thereof, e) said second clamping jaw comprising a second crimping zone formed by an arcuately shaped recess formed adjacent the distal end thereof and positioned in cooperating, facing relationship with the arcuately shaped recess of the first clamping jaw for establishing a substantially circular shaped crimping zone, f) said first clamping jaw comprising a first pivot axis formed along the length thereof between the distal end and the proximal end thereof, and said second clamping jaw comprising a second pivot axis formed along the length thereof between the distal end and the proximal end thereof, with the first pivot axis and said second pivot axis being positioned in spaced, cooperating relationship with each other, the proximal ends of each of said first and second clamping jaws having a receiving aperture, g) a tie plate extending between the first clamping jaw and the second clamping jaw, with one end of the tie plate being secured to the first clamping jaw through the first pivot axis and the second end of the tie plate being secured to the second clamping jaw through the second pivot axis, whereby said tie plate cooperates with the first clamping jaw and the second clamping jaw to assure cooperating pivoting movement thereof between a first crimping zone opened position and a second, crimping zone closed position, and E. a connecting assembly a) pivotally mounted to each of the first and second elongated handles about two separate pivot axes spaced from the center pivot axis which create a compound over center toggle action upon movement of the first and second elongated handles, and b) constructed with a rotational stud portion for each of the first and second elongated handles and extending therefrom through the receiving apertures in the proximal ends of said first and second clamping laws for pivotally interconnecting the clamping jaw assembly with the first and second elongated handles and maintaining the clamping jaw assembly in a desired angular relationship relative to the first and second elongated handles.

2. The crimping tool defined in claim 1, wherein said connecting assembly has:

c) a first post member incorporating a block portion constructed for being pivotally affixed to the proximal end of the first elongated handle and having the rotational stud portion extending therefrom and through the receiving aperture formed in the proximal end of the first clamping jaw, d) a second post member incorporating a block portion constructed for being pivotally affixed to the proximal end of the first elongated handle and having the rotational stud portion extending therefrom and through the receiving aperture formed in the proximal end of the second clamping jaw, and e) the rotational stud portion of the first post member being formed with a desired angular relationship to the block portion thereof and the rotational stud portion of the second post member being formed with a desired angular relationship to the block portion thereof, whereby the clamping jaw assembly is maintained at a desired angular relationship to the first and second elongated handles when said clamping jaw assembly is rotationally affixed to the connecting assembly.

3. The crimping tool defined in claim 2, wherein the angular relationship between the block portion and the rotational stud portion of the first post member and second post member is further defined as ranging between about 45° and 180°.

4. The crimping tool defined in claim 2, wherein the rotational stud portion extends from the block portion of both the first post member and the second post member along a substantially continuous central axes, thereby maintaining the clamping jaw assembly at substantially right angles to the first and second elongated handles when said crimping tool is fully assembled.

5. The crimping tool defined in claim 1, wherein the connecting assembly is further defined as being adjustable for enabling the clamping jaw assembly to be arcuately pivotable relative to the first and second elongated handles for enabling the clamping jaw assembly to be positioned in a plurality of alternate angular orientations relative to the elongated handles.

6. The crimping tool defined in claim 5, wherein the clamping jaw assembly is arcuately positionable relative to the first and second elongated handles in alternate orientations ranging up between about 0° and 90°, or 90° and 180°, while also being securable in any desired orientation.

7. The crimping tool defined in claim 6, wherein the clamping jaw assembly is securable in alternate arcuate positions relative to the first and second elongated handles in increments of 22.5°.

8. The crimping tool defined in claim 5, wherein the connecting assembly has:

c) a first bracket member incorporating a block portion pivotally affixed to the proximal end of the first elongated handle and a pair of wall members extending coaxially from the block portion, d) a second bracket member incorporating a block portion pivotally affixed to the proximal end of the second elongated handle and a pair of wall members extending coaxially from the block portion, e) a first swivel plate incorporating a substantially flat plate portion mounted between the wall members of the first bracket member for enabling the plate portion to be arcuately pivotable relative to the wall members and a having the rotational post member longitudinally extending from the plate portion and through the receiving aperture formed in the proximal end of the first clamping jaw, and f) a second swivel plate incorporating a substantially flat plate portion mounted between the wall members of the second bracket member for enabling the plate portion to be arcuately pivotable relative to the wall members and a having the rotational post member longitudinally extending from the plate portion and through the receiving aperture formed in the proximal end of the second clamping jaw;

whereby the first and second clamping jaws of the clamping jaw assembly are simultaneously arcuately pivotable relative to the first and second elongated handles due to the arcuate movement of the first and second swivel plates within the first and second bracket members.

9. The crimping tool defined in claim 8, wherein the plate portion of the first and the second swivel plates are further defined as comprising a plurality of curved recess zones formed on one side edge thereof with said recess zones being positioned in side to side adjacent relationship, and the block portion of the first and second bracket members are further defined as comprising a longitudinally extending cavity formed therein and incorporating a spring biased locking ball mounted therein for cooperative engagement with each of the recess zones of the plate portions for maintaining the plate portions of the first and second swivel plates in a desired angular position whenever a recess zone is aligned with the locking ball, whereby the clamping jaw assembly is quickly and easily alternately positionable into any desired angular orientation relative to the first and second elongated handles with that position being maintained by the engagement of the locking ball in the recess zone.

10. The crimping tool defined in claim 1, wherein the first clamping jaw and the second clamping jaw each comprise substantially flat side edges and are mounted in side to side relationship as mirror images of each other, with the first crimping zone of the first clamping jaw being formed in the side edge thereof and comprise an arcuately curved surface extending about 180°, terminating at each end with the side edge of the first clamping jaw.

11. The crimping tool defined in claim 10, wherein the second crimping zone of the second clamping jaw is formed in the side edge thereof and comprises an arcuately curved surface extending about 180°, terminating at each end with the side edge of the second clamping jaw, and cooperatively associated with the first crimping zone of the first clamping jaw to form a substantially circular shaped crimping zone when said jaws are in their closed position.

12. The crimping tool defined in claim 11, wherein the first crimping zone and second crimping zone are further defined as comprising one selected from the group consisting of smooth, toothless surfaces and slightly raised, tooth-bearing surfaces.

13. The crimping tool defined in claim 11, wherein the first clamping jaw is constructed for arcuate pivoting movement about the first pivot axis in response to movement of the first handle member and the second clamping jaw is constructed for arcuate pivoting movement about the second pivot axis in response to movement of the second handle member, said first pivot axis and said second pivot axis being in spaced, cooperating relationship for causing the crimping zone to be open when said first clamping jaw and said second clamping jaw are pivoted into the first position while also being closed when said first clamping jaw and said second clamping jaw are pivoted into the second position, with said second position being defined by abutting contact between the side edge of the first clamping jaw adjacent the first crimping zone with the side edge of the second clamping jaw adjacent the second crimping zone, with said contact being achieved substantially simultaneously.

14. The crimping tool defined in claim 13, wherein the center of the crimping zone, the first pivot axis, and the second pivot axis define a substantially triangular shape.

15. The crimping tool defined in claim 14, wherein the triangular shape is further defined as comprising one selected from the group consisting of equilateral triangles and isosceles triangles.

16. The crimping tool defined in claim 15, wherein the crimping zone is further defined as comprising a diameter of 0.5 inches in the base of the triangle is further defined as ranging between about 2.8 and 3.0 cm.

17. The crimping tool defined in claim 14, wherein the spaced distance between the first pivot axis and the first pivot defining securing pin is substantially equal to the spaced distance between the second pivot axis and the second pivot defining securing pin.

18. The crimping tool defined in claim 14, wherein the base of the triangle is further defined as being constructed with a minimum length which enables the first clamping jaw and second clamping jaw to arcuately pivot in a manner which enables the side edges adjacent the first crimping zone and the side edges adjacent the second crimping zone to be brought into contact with each other in a substantially single plane as the first and second clamping jaws are moved into their second, closed position.

19. The crimping tool defined in claim 18, wherein the first clamping jaw and the second clamping jaw each arcuately pivot about two separate and independent axes in response to the movement of the handle members, and the spaced distance between the first pivot axis and the second pivot axis being maintained at a minimum in order to produce substantially increased forces on the arcuately curved surfaces of the first crimping zone and the second crimping zone as the surfaces peripherally surround and compress the cylindrical ring into engagement with the cylindrical pipe and overlying connecting tube, thereby enabling the crimping tool of the present invention to securely a fix the cylindrical ring in the desired position with greater ease and efficiency.

* * * * *